US010449745B2

(12) United States Patent
Kiskaden et al.

(10) Patent No.: US 10,449,745 B2
(45) Date of Patent: Oct. 22, 2019

(54) MANUFACTURING DIE SPACING DEVICES

(71) Applicant: Toyota Motor Engineering & Manufacturing North America, Inc., Erlanger, KY (US)

(72) Inventors: James A. Kiskaden, Corinth, KY (US); James M. Farthing, Cynthiana, KY (US); Lawrence J. Pelotte, Lexington, KY (US)

(73) Assignee: TOYOTA MOTOR ENGINEERING & MANUFACTURING NORTH AMERICA, INC., Plano, TX (US)

( * ) Notice: Subject to any disclaimer, the term of this patent is extended or adjusted under 35 U.S.C. 154(b) by 647 days.

(21) Appl. No.: 14/683,602

(22) Filed: Apr. 10, 2015

(65) Prior Publication Data

US 2016/0297162 A1 Oct. 13, 2016

(51) Int. Cl.
*B30B 15/28* (2006.01)
*B21D 37/12* (2006.01)

(52) U.S. Cl.
CPC ..... *B30B 15/287* (2013.01); *B21D 37/12* (2013.01)

(58) Field of Classification Search
CPC ..... B21D 37/02; B21D 37/10; B21D 37/12; B21D 37/14; B30B 15/02; B30B 15/026; B30B 15/28; B30B 15/287; B21J 13/02; B23B 31/00; B23B 31/1175
USPC ..... 72/402; 279/2.01, 2.05, 2.14
See application file for complete search history.

(56) References Cited

U.S. PATENT DOCUMENTS

| | | | | |
|---|---|---|---|---|
| 3,568,495 | A * | 3/1971 | Duffield | B21D 41/00 72/402 |
| 4,377,084 | A | 3/1983 | Kaminshi | |
| 4,400,967 | A * | 8/1983 | Owens | B21D 39/046 72/402 |
| 5,016,458 | A * | 5/1991 | De Smet | B21D 22/10 29/421.1 |
| 6,089,148 | A | 6/2000 | Bloomer | |
| 6,718,814 | B2 * | 4/2004 | Bartrom | B21J 7/14 72/402 |
| 2011/0038979 | A1 | 2/2011 | Kumamoto | |
| 2014/0304991 | A1 * | 10/2014 | Lin | B21D 22/02 29/897.3 |
| 2014/0331735 | A1 | 11/2014 | Scattolon | |

FOREIGN PATENT DOCUMENTS

| | | |
|---|---|---|
| JP | 2011161721 | 8/2011 |

* cited by examiner

*Primary Examiner* — Teresa M Ekiert
(74) *Attorney, Agent, or Firm* — Dinsmore & Shohl LLP

(57) ABSTRACT

A die spacing device including a die spacing device body having a first arcuate piece sized and configured to extend about a portion of a guide pin of a manufacturing die, a second arcuate piece sized and configured to extend about another portion of the guide pin of the manufacturing die, and a flexible resilient member channel disposed in the first arcuate piece and the second arcuate piece. A flexible resilient member is configured to fit within the flexible resilient member channel and is configured to apply an inward radial force to the first arcuate piece and the second arcuate piece in contracted and extended configurations.

13 Claims, 7 Drawing Sheets

MANUFACTURING DIE SPACING DEVICES

TECHNICAL FIELD

The present specification generally relates to manufacturing and repair die systems and, more particularly, to manufacturing and repair die systems including a manufacturing die and one or more die spacing devices configured to be temporarily coupled to the manufacturing die.

BACKGROUND

Spacing blocks may be positioned throughout a manufacturing die to obstruct movement between components of the manufacturing die. However, the spacing blocks may be inconsistently positioned and sized such that the spacing blocks may provide inconsistent obstruction between components of the manufacturing die. Further, a user may forget to remove the spacing blocks, which may cause damage to the manufacturing die during operation of the manufacturing die.

Accordingly, there is a desire for removable manufacturing die spacing devices that provide a consistent positive stop between the components of the manufacturing die.

SUMMARY

In one embodiment, a die spacing device includes a die spacing device body having a first arcuate piece sized and configured to extend about a portion of a guide pin of a manufacturing die, a second arcuate piece sized and configured to extend about another portion of the guide pin of the manufacturing die, and a flexible resilient member channel disposed in the first arcuate piece and the second arcuate piece. A flexible resilient member is configured to fit within the flexible resilient member channel and is configured to apply an inward radial force to the first arcuate piece and the second arcuate piece in contracted and extended configurations.

In another embodiment, a manufacturing die system includes a manufacturing die having an upper die shoe with an upper die shoe cutting surface and a guide pin extending from the upper die shoe, a lower die shoe with a lower die shoe cutting surface and a guide pin receiving hole configured to receive the guide pin, and a die spacing device engageable with the guide pin. The die spacing device includes a die spacing device body having a first arcuate piece sized and configured to extend about a portion of the guide pin, a second arcuate piece sized and configured to extend about another portion of the guide pin, and a flexible resilient member channel disposed in the first arcuate piece and the second arcuate piece. A flexible resilient member is configured to fit within the flexible resilient member channel of the first arcuate piece and the second arcuate piece and is configured to apply an inward radial force to the first arcuate piece and the second arcuate piece in contracted and expanded configurations. The die spacing device frictionally engages the guide pin when the first arcuate piece extends about a portion of the guide pin, the second arcuate piece extends about another portion of the guide pin, and the flexible resilient member applies an inward radial force to the first arcuate piece and the second arcuate piece.

In yet another embodiment, a method of spacing a manufacturing die includes providing a die spacing device including a die spacing device body having a first arcuate piece sized and configured to extend about a portion of a guide pin of a manufacturing die, a second arcuate piece sized and configured to extend about another portion of the guide pin of the manufacturing die, and a flexible resilient member channel disposed in the first arcuate piece and the second arcuate piece. A flexible resilient member is configured to fit within the flexible resilient member channel of the first arcuate piece and the second arcuate piece and is configured to apply an inward radial force to the first arcuate piece and the second arcuate piece in contracted and extended configurations. The method further includes positioning the first arcuate piece and the second arcuate piece about a guide pin of a manufacturing die, engaging the die spacing device with the guide pin such that the first arcuate piece and the second arcuate piece apply an inward radial force to the guide pin, and providing, using the die spacing device, a positive stopping location between an upper die shoe of the manufacturing die and a lower die shoe of the manufacturing die.

These and additional features provided by the embodiments described herein will be more fully understood in view of the following detailed description, in conjunction with the drawings.

BRIEF DESCRIPTION OF THE DRAWINGS

The embodiments set forth in the drawings are illustrative and exemplary in nature and not intended to limit the subject matter defined by the claims. The following detailed description of the illustrative embodiments can be understood when read in conjunction with the following drawings, where like structure is indicated with like reference numerals and in which:

DETAILED DESCRIPTION

Embodiments described herein generally relate to manufacturing die assemblies including manufacturing dies having guide pins and die spacing devices configured to be removably engaged on the guide pins. The die spacing devices include arcuate pieces and one or more flexible resilient members extendable around the arcuate pieces to provide an inward radial force to the arcuate pieces. In particular, the die spacing devices may be removably positioned in a frictional engagement with each guide pin of the manufacturing die to provide a temporary positive stop between an upper guide shoe and a lower guide shoe such that an upper die cutting portion of the upper die shoe may be separated from a lower die cutting portion of the lower die shoe in a reliable fashion.

Figure 1:
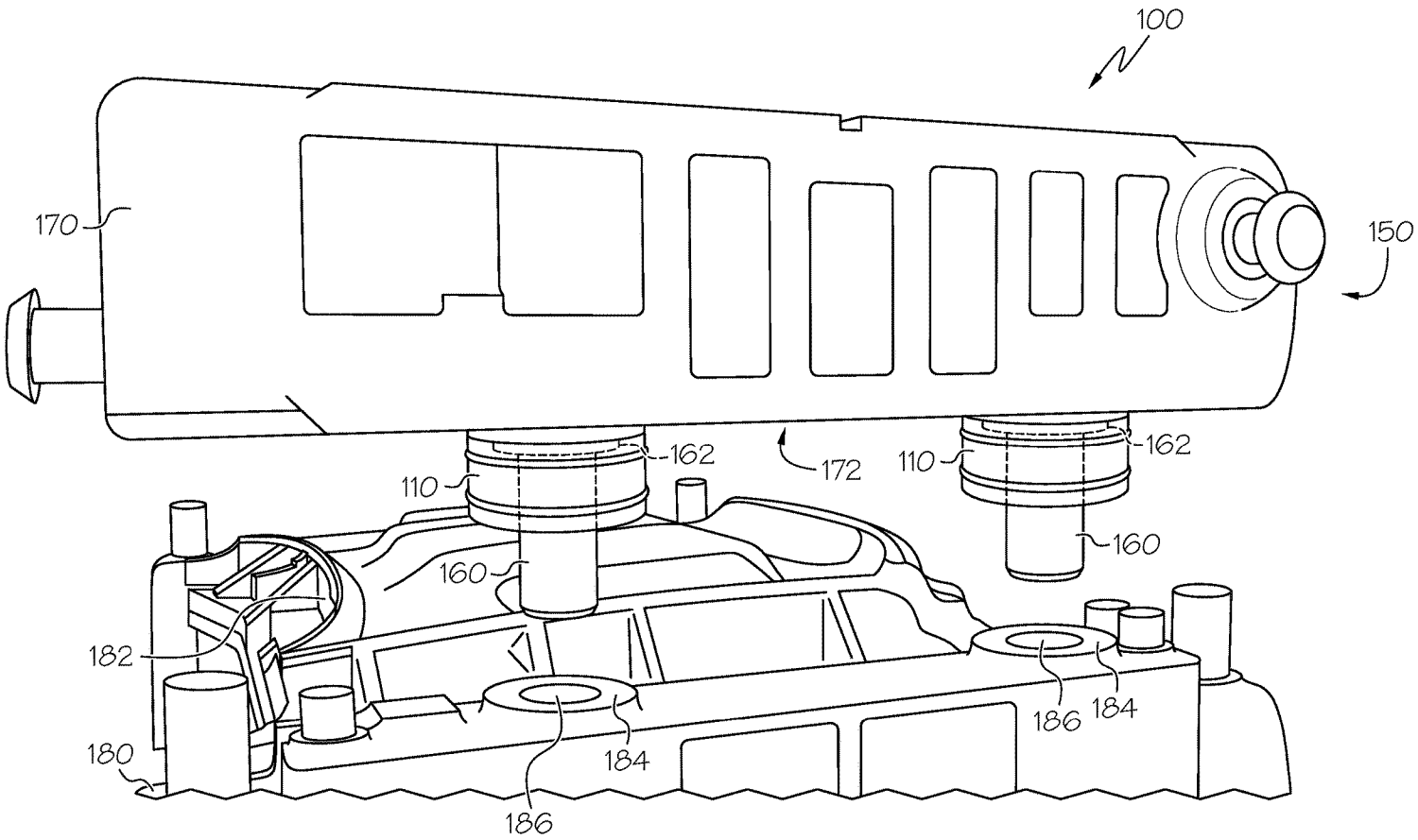
FIG. 1 depicts a manufacturing die system including a manufacturing die and die spacing devices positioned on guide pins of the manufacturing die according to one or more embodiments shown or described herein.

Referring now to FIG. 1, a manufacturing die system 100 is depicted. The manufacturing die system 100 includes a manufacturing die 150 having an upper die shoe 170 and a lower die shoe 180. The upper die shoe 170 includes an upper die shoe cutting surface 172 and one or more guide pins 160 extending outwardly from the upper die shoe 170 toward the lower die shoe 180. The lower die shoe 180 includes a lower die shoe cutting surface 182 and one or more guide pin receiving portions 184 having one or more guide pin receiving holes 186 facing the upper die shoe 170 positioned in alignment with the guide pins 160 of the upper die shoe 170. In some embodiments, the guide pins 160 include a guide pin protruding portion 162, such as, for example, a guide pin split ring. The guide pin protruding portion 162 generally extends radially outward from the respective guide pin 160 having an outer diameter greater than the respective guide pin 160. The manufacturing die system 100 further comprises one or more die spacing devices 110 that may be removably coupled to the guide pins 160, for example, in a frictional engagement. Further, when the die spacing devices 110 are coupled to the guide pins 160, the die spacing devices 110 may provide a positive stop between the upper die shoe 170 and the lower die shoe 180 to provide more reliable positioning of the upper die shoe 170 relative to the lower die shoe 180 during a manufacturing operation.

Figure 2:
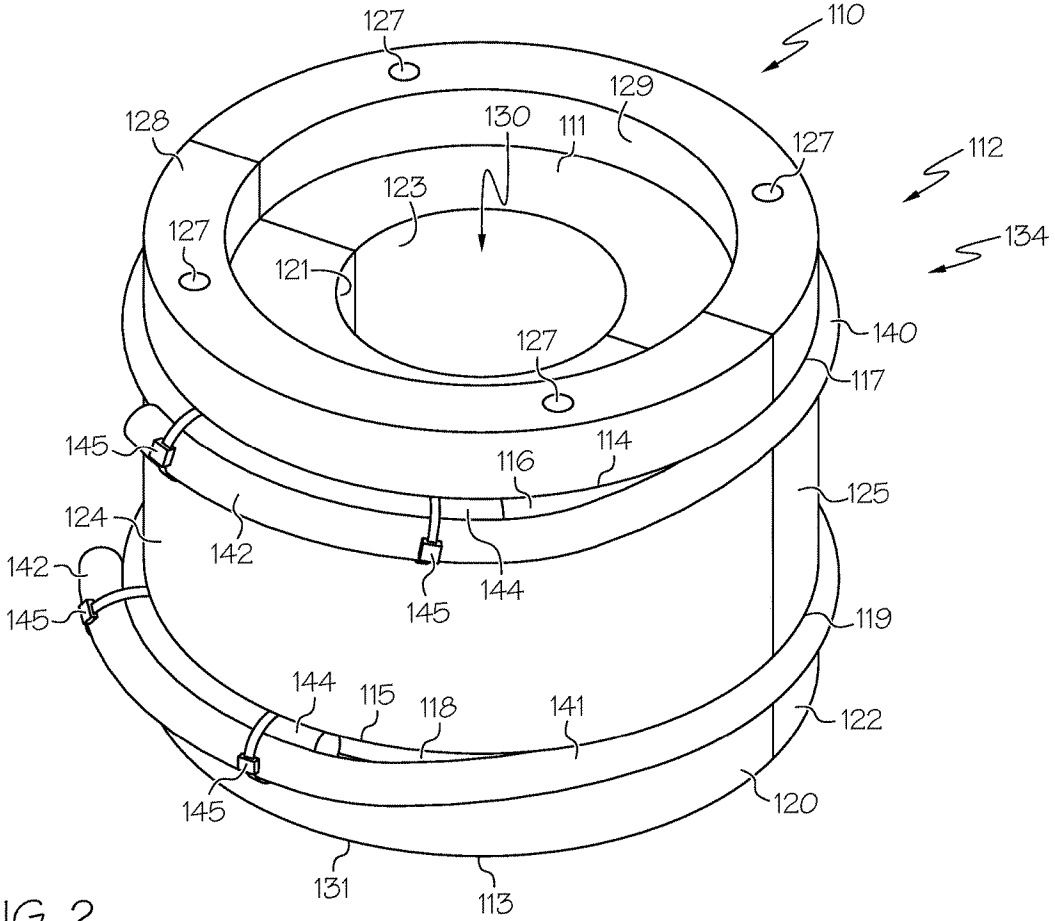
FIG. 2 depicts an isometric view of an example die spacing device in a contracted configuration according to one or more embodiments shown or described herein.
Figure 3:
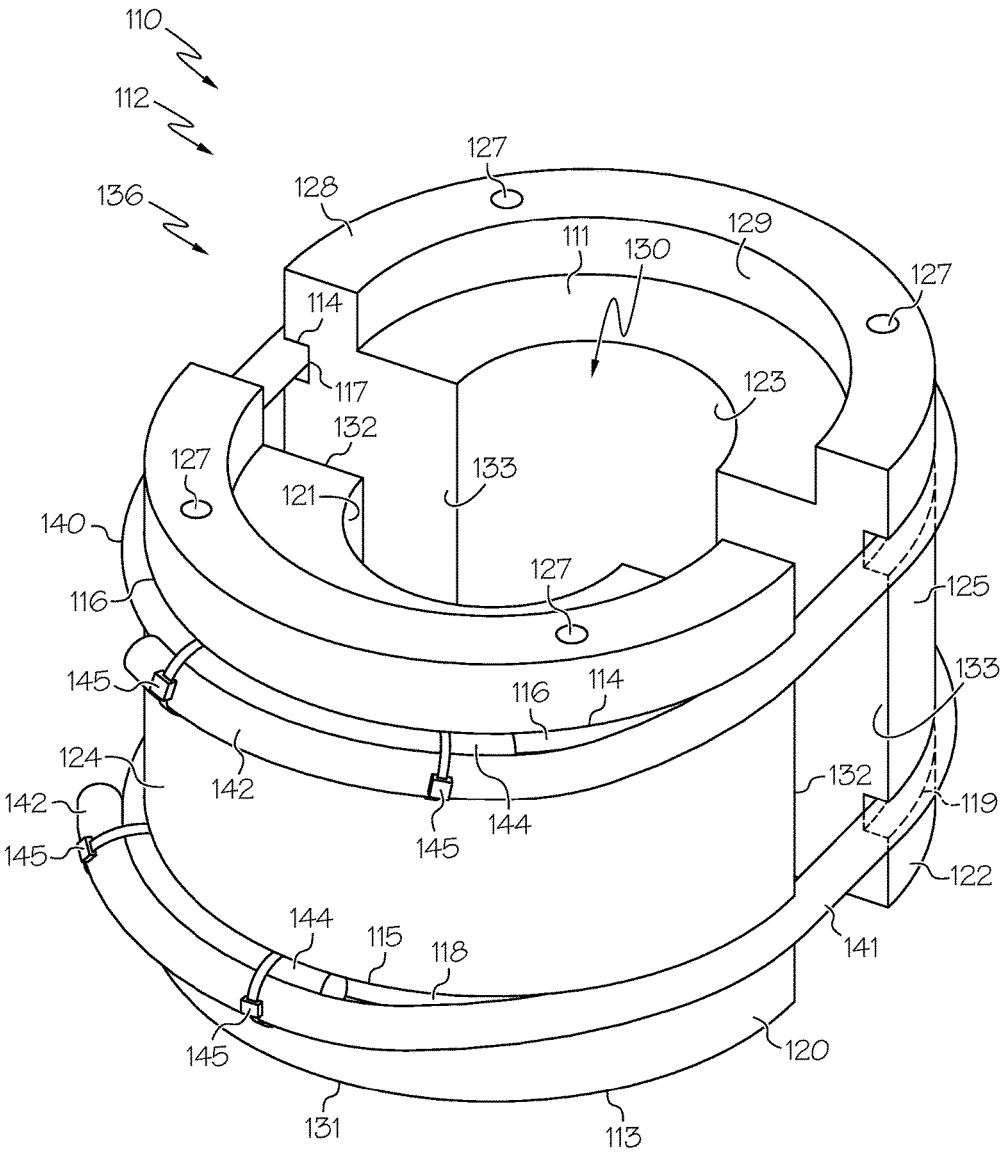
FIG. 3 depicts an isometric view of the die spacing device of FIG. 2 in an expanded configuration according to one or more embodiments shown or described herein.

Referring now to FIGS. 2 and 3, the die spacing device 110 is depicted in more detail. The die spacing device 110 includes a die spacing device body 112 having a first arcuate piece 120 and a second arcuate piece 122 configured to fit together and form a circular opening 130 extending through the die spacing device body 112 from a top 111 of the die spacing device body 112 to a bottom 113 of the die spacing device body 112, between the first arcuate piece 120 and the second arcuate piece 122. Further, the first arcuate piece 120 and the second arcuate piece 122 each comprise an inner surface 121 and 123 facing the circular opening 130, an outer surface 124 and 125 facing outward from the die spacing device body 112, and side faces 132 and 133 (FIG. 3). The side faces 132 and 133 are positioned such that when the first arcuate piece 120 and the second arcuate piece 122 are fit together in a contracted configuration 134, the side faces 132 of the first arcuate piece 120 and the side faces 133 of second arcuate piece 122 are in contact forming a seam (FIG. 2).

In some embodiments, the first arcuate piece 120 and the second arcuate piece 122 of the die spacing device body 112 may each comprise a half round shape (i.e. 180°). In other embodiments, the die spacing device body 112 may comprise any number of arcuate pieces, for example, three 120° arcuate pieces, four 90° arcuate pieces, or the like. Further, the arcuate pieces may be non-uniform sizes, such as, for example, a die spacing body 112 may comprise a 240° arcuate piece and a 120° arcuate piece. Additionally, in alternative embodiments, the die spacing device body 112 may comprise a single integral piece. Further, the die spacing device body 112 may comprise any height, for example, 50-500 mm, such as 100 mm, 200, mm, 400 mm, or the like.

The die spacing device body 112 may comprise any exemplary material, for example, a plastic, a polymer (e.g. urethane), or the like, having elasticity and compressibility. When the die spacing device body 112 comprises a compressible material, the die spacing body 112 may compress when force is applied by the upper die shoe 170 and the lower die shoe 180 of the manufacturing die 150 (FIG. 1). By compressing, the die spacing body 112 may absorb pressure applied by the upper die shoe 170 and the lower die shoe 180. This compression may prevent damage to the upper die shoe 170 and the lower die shoe 180 by inhibiting unintended contact between the upper die shoe 170 and the lower die shoe 180. Further, the die spacing device body 112 is elastic such that after compression, the die spacing device body 112 returns to its original shape. For example, an example die spacing device 110 comprising a height of about 103 mm may be compressed to a height of about 20 mm. After compression, the example die spacing device 110 can return to its original height, within a tolerance of about 1 mm or less. Additionally, because the die spacing device body 112 is elastic and compressible, fragmentation does not occur when force is applied to the die spacing device body 112.

Referring still to FIGS. 2 and 3, the die spacing body 112 further includes end surfaces 128 and 131. In some embodiments, the end surface 128 may be a substantially planar surface configured to sit flush against the upper die shoe 170 in one direction and the end surface 131 is configured to sit flush against the lower die shoe 180, for example against the guide pin receiving portion 184 of the lower die shoe 180. In some embodiments, the end surface 128 includes a shoulder portion 129 comprising a counterbore, countersink, or the like, having an inner diameter that is larger than an inner diameter of the circular opening 130. The shoulder portion 129 may be sized and configured to engage with the guide pin protruding portion 162 of the guide pin 160, for example, a guide pin split ring. The end surfaces 128 and 131 may be substantially identical such that either end surface 128 and 131 may be interchangeably oriented to face the upper die shoe 170 or the lower die shoe 180 when the die spacing device 110 is coupled to the guide pin 160. For example, both end surfaces 128 and 131 may be include matching planar surfaces and both end surfaces 128 and 131 may include matching shoulder portions 129. In some embodiments, the end surfaces 128 and 131 may also comprise one or more alignment features 127, such as, for example, one or more indented portions, one or more raised portions, or a combination of both. The alignment features 127 may be configured to correspond with one or more surface features of the upper die shoe 170 and/or the lower die shoe 180 to help align the die spacing device 110 in a particular position on the guide pin 160 between the upper die shoe 170 and the lower die shoe 180.

Referring still to FIGS. 2 and 3, the die spacing device body 112 includes flexible resilient member channels 114 and 115 positioned in the first arcuate piece 120 and the second arcuate piece 122. The flexible resilient member channel 114 may comprise one or more groove portions 116 and 117 and the flexible resilient member channel 115 may include one or more groove portions 118 and 119. When in the contracted configuration 134, the groove portions 116 and 117 and the groove portions 118 and 119 are arranged to mate to form the flexible resilient member channels 114 and 115. The flexible resilient member channels 114 and 115 may form continuous pathways around and/or through the first arcuate piece 120 and the second arcuate piece 122. Further, the flexible resilient member channels 114 and 115 may provide pathways for flexible resilient members 140 and 141 to fit within the flexible resilient member channel 114 and couple the first arcuate piece 120 to the second arcuate piece 122 together between the contracted configuration 134 and an expanded configuration 136.

When the flexible resilient member channel 114 comprises one or more groove portions 116 and 117 and the flexible resilient member channel 115 comprises one or more groove portions 118 and 119, the flexible resilient member channels 114 and 115 extend circumferentially around the die spacing body 112 without passing through the die spacing body 112. This allows the flexible resilient members 140 and 141 to extend around and engage the die spacing body 112, as depicted in FIGS. 1-6. In some embodiments, die spacing device body 112 may comprise a plurality of flexible resilient member channels 114 and 115 configured to provide a pathway for a plurality of flexible resilient members 140 and 141. In these embodiments, the flexible resilient member channels 114 and 115 may be disposed at different heightwise positions on the die spacing device body 112 and extend substantially parallel to one another. In other embodiments, the flexible resilient member channels 114 and 115 may intersect, crisscrossing one another.

Referring still to FIGS. 2 and 3, the flexible resilient members 140 and 141 may be any exemplary plastic, elastomer, polymer, rubber, or the like, extendable around the die spacing device body 112 within the flexible resilient member channel 114. Further, the flexible resilient members 140 and 141 may apply an inward radial force to the die spacing body 112 to press the side faces 132 of the first arcuate piece 120 and the side faces 133 of the second arcuate piece 122 into contact in the contracted configuration 134. Further, when the first arcuate piece 120 and the second arcuate piece 122 are positioned about the guide pin 160, the inward radial force applied to the first and second arcuate pieces 120, 122 by the flexile resilient member 140 frictionally engages the die spacing device 110 the guide pin 160.

In some embodiments, the flexible resilient members 140 and 141 may comprise a cord, such as a bungee cord, rubber cord, shock cord, or the like, having a first end 142 and a second end 144. In some embodiments, the flexible resilient members 140 and 141 may be continuous, without ends and comprise a ring, such as an o-ring, or the like. The flexible resilient members 140 and 141 may be any diameter or thickness, for example, ¼", ⅜", ½", ¾", 1", or the like. Further, the die spacing device 110 may include a plurality of flexible resilient members 140 and 141, each extending around the die spacing device body 112 along an individual flexible resilient member channel 114 and 115, for example, two, three, or more flexible resilient members 140 and 141, to apply increased inward radial force on the die spacing body 112.

Referring still to FIGS. 2 and 3, the die spacing device 110 may further comprise one or more flexible resilient member attachment mechanisms 145 configured to couple the first end 142 of the flexible resilient member 140 to the second end 144 to fasten the flexible resilient members 140 and 141 around the die spacing body 112 and provide an inward radial force on the die spacing device body 112. The flexible resilient member attachment mechanisms 145 may comprise any exemplary fastener, such as a cable tie, plastic fastener, wire fastener, clasping device, or the like. In operation, the flexible resilient member attachment mechanisms 145 may attached to the flexible resilient members 140 and 141 at any position along the first end 142 and the second end 144 to alter how tight the flexible resilient members 140 and 141 are stretched along the flexible resilient member channels 114 and 115 and alter the inward radial force applied by the flexible resilient members 140 and 141 to the die spacing device body 112.

Referring still to FIGS. 2 and 3, the die spacing device 110 may be selectively positioned in the contracted configuration 134 or the expanded configuration 136. In the contracted configuration 134, (FIG. 2) the side faces 132 of the first arcuate piece 120 are in contact with the side faces 133 of the second arcuate piece 122 forming a seam. The die spacing device 110 may be placed in the contracted configuration 134 by extending the flexible resilient members 140 and 141 into engagement with the die spacing device body 112, for example, within the flexible resilient member channels 114 and 115 of the die spacing device body 112, to provide an inward radial force to the die spacing device body 112. In some embodiments, by placing the die spacing device 110 in the contracted configuration 134, the die spacing device 110 may be coupled to the guide pin 160 using a frictional engagement applying pressure against the guide pin 160 due to a reduced inner diameter of the circular opening 130. In the expanded configuration 136, (FIG. 3) the first arcuate piece 120 and the second arcuate piece 122 may be spaced apart such that the side faces 132 of the first arcuate piece 120 are not in contact with the side faces 133 of the second arcuate piece 122. The die spacing device 110 may be placed in the expanded configuration 136 by loosening or removing the engagement between the flexible resilient members 140 and the die spacing body 112, for example, by removing the flexible resilient member attachment mechanisms 145.

Figure 4:
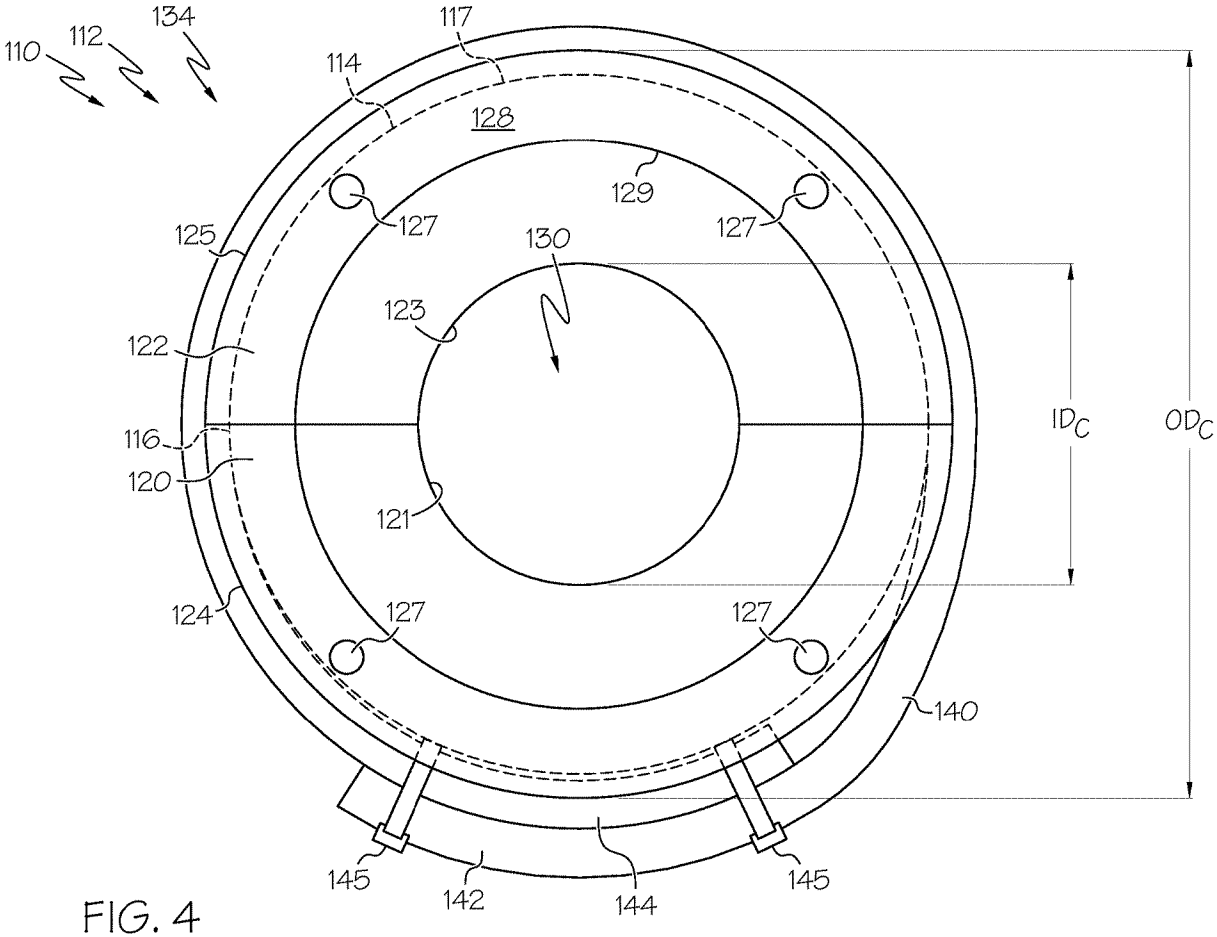
FIG. 4 depicts a top view of the die spacing device of FIG. 2 positioned in a contracted configuration according to one or more embodiments shown or described herein.

Referring now to FIG. 4, a top view of the die spacing device 110 positioned in the contracted configuration 134 is depicted. In the contracted configuration 134, the die spacing device body 112 has a contracted inner diameter $ID_C$ and a contracted outer diameter $OD_C$. In some embodiments, the contracted inner diameter $ID_C$ is the diameter of the inner surfaces 121 and 123 of the die spacing device body 112 (e.g., the diameter of the circular opening 130) and the contracted outer diameter $OD_C$ is the diameter of the outer surface 124, 125 of the die spacing device body 112. The contracted inner diameter $ID_C$ may be any size, for example 25-500 mm, such as, 50 mm, 100 mm, 200 mm, 350 mm, or the like. The contracted outer diameter $OD_C$ may be any size, for example 50-1000 mm, such as, 100 mm, 200 mm, 500 mm, 750 mm, or the like. In some embodiments, the contracted outer diameter $OD_C$ may be double the contracted inner diameter $ID_C$.

Referring still to FIG. 4, the die spacing device body 112 may be designed such that the contracted inner diameter $ID_C$ is equal to or smaller than the diameter of the guide pin 160 of the manufacturing die 150 (FIGS. 1 and 6), for example 1-5 mm smaller, such that when the die spacing device 110 is coupled to the guide pin 160, the inner surface 121 of the first arcuate piece 120 and the inner surface 123 of the second arcuate piece 122 contact the guide pin 160 and apply an inward radial force to the guide pin 160. In one example embodiment, the diameter of the guide pin 160 is 100 mm and the contracted inner diameter $ID_C$ of the die spacing device body 112 is between about 95 mm and about 100 mm, such as, for example, about 98 mm. It should be understood that exemplary guide pins 160 may be a variety of sizes and the die spacing device 110 may comprise any size and configuration to frictionally engage guide pins 160 having a variety of diameters and heights, e.g., diameters of 60 mm, 80 mm, or the like.

Figure 5:
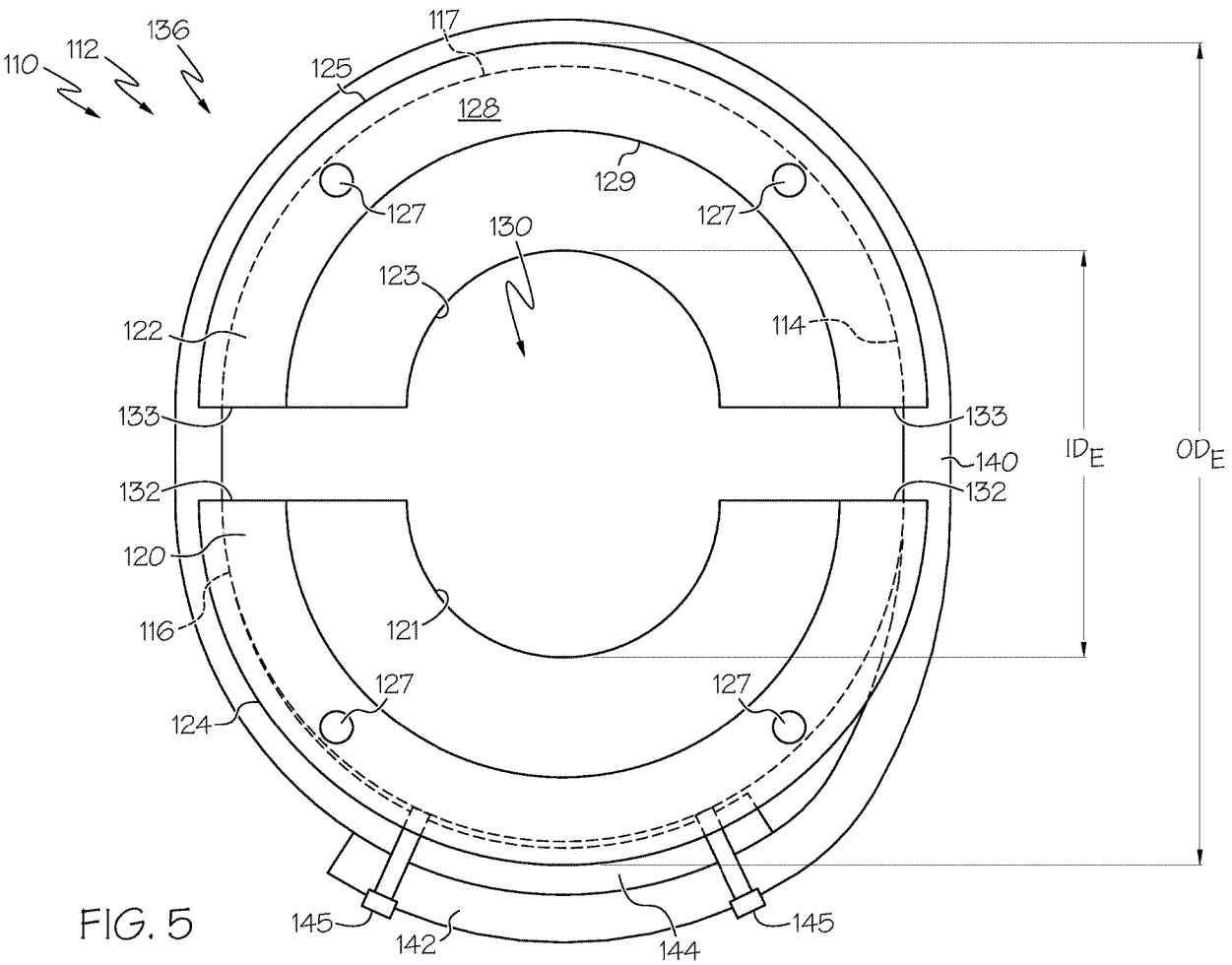
FIG. 5 depicts a top view of the die spacing device of FIG. 2 positioned in an expanded configuration according to one or more embodiments shown and described herein.

Referring now to FIG. 5, a top view of the die spacing device 110 positioned in the expanded configuration 136 is depicted. In the expanded configuration 136, the die spacing device body 112 has an expanded inner diameter $ID_E$ and an expanded outer diameter $OD_E$, which are larger than the contracted inner diameter $ID_C$ and the contracted outer diameter $OD_C$. For example, the expanded inner diameter $ID_E$ and the expanded outer diameter $OD_E$ are the size of the contracted inner diameter $ID_C$ and the contracted outer diameter $OD_C$, respectively, plus the distance the side faces 132 of the first arcuate piece 120 and the side faces 133 of the second arcuate piece 122 are spaced apart. The expanded inner diameter $ID_E$ and an expanded outer diameter $OD_E$ may be any size greater than the contracted inner diameter $ID_C$ and the contracted outer diameter $OD_C$. Further, in some embodiments, the expanded inner diameter $ID_E$ may be larger than the diameter of the guide pin 160 such that the die spacing device 110 may be removed from a frictional engagement with the guide pin 160 when the die spacing device 110 is in the expanded configuration 136.

Figure 6:
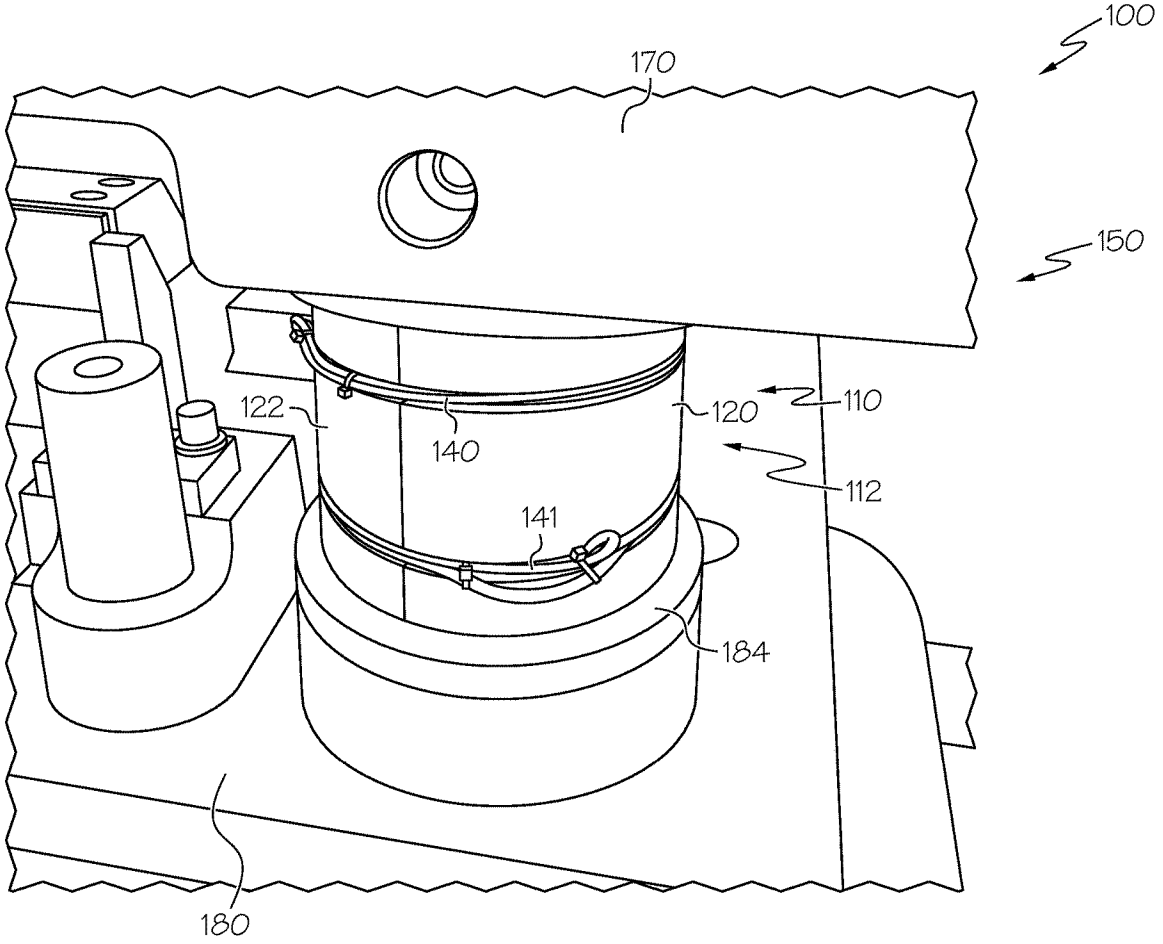
FIG. 6 depicts an isometric view of the die spacing device of FIG. 2 positioned on a guide pin in contact with an upper die shoe and a lower die shoe according to one or more embodiments shown or described herein.

Referring now to FIGS. 1 and 6, the die spacing devices 110 may be coupled to the plurality of guide pins 160 of the manufacturing die 150. For example, an individual die spacing device 110 may first be positioned on the guide pin 160 such that the inner surface 121 of the first arcuate piece 120 and the inner surface 123 second arcuate piece 122 extend about portions of the guide pin 160. Next, the die spacing device 110 may be placed in the contracted configuration 134 such that the inner surface 121 of the first arcuate piece 120 and the inner surface 123 of the second arcuate piece 122 are placed in a frictional engagement with the guide pin 160. When the die spacing device 110 is in a frictional engagement with the guide pin 160, the flexible resilient member 140 applies inward radial force to compress the die spacing body 112 into frictional engagement with the guide pins 160. In alternative embodiments, the die spacing device 110 may be placed in the contracted configuration 134 before the die spacing device 110 is positioned on the guide pin 160. In this embodiment, the die spacing device 110 may be placed into frictional engagement with the guide pin 160 by sliding the contracted die spacing device 110 onto the guide pin 160, for example, with a mallet, hammer, or the like.

Referring still to FIGS. 1 and 6, when the die spacing devices 110 are coupled to the guide pins 160 of the manufacturing die 150, the die spacing devices 110 may provide a positive stop between the upper die shoe 170 and the lower die shoe 180. For example, as depicted in FIG. 6, when the die spacing devices 110 are coupled to the guide pins 160, the end surfaces 128 and 131 of the die spacing device body 112 may be placed in contact with the upper die shoe 170 and the lower die shoe 180 (e.g., the guide pin receiving portion 184 of the lower die shoe 180), ensuring that the upper die shoe 170 does not contact the lower die shoe 180. For example, the die spacing devices 110 may be coupled to the guide pins 160 to provide a positive stopping location such that the upper die shoe cutting surfaces 172 cannot contact the lower die shoe cutting surfaces 182. Further, the die spacing devices 110 are removable. This allows the die spacing devices 110 to be temporarily positioned on the guide pin 160 to provide a temporary positive stop between the upper die shoe 170 and the lower die shoe 180 and removed when a positive stop is no longer desired. Additionally, in some embodiments, the frictional engagement between the die spacing device 110 and the guide pin 160 is strong enough to hold the die spacing device 110 on the guide pin 160 when the guide pin 160 is coated with a lubricant.

Referring again to FIGS. 1 and 6, the die spacing devices 110 may be coupled to the one or more guide pins 160 of the manufacturing die 150 anytime a positive stop between the upper die shoe 170 and the lower die shoe 180 is desired. For example, before the manufacturing die 150 undergoes a spotting process, the upper die shoe cutting surfaces 172 and the lower die shoe cutting surfaces 182 may be misaligned such that they may come into contact when the upper die shoe 170 and the lower die shoe 190 are in contact, damaging the cutting surfaces. By placing the die spacing devices on the guide pins 160, the positive stop ensures that the upper die shoe cutting surfaces 172 do not contact the lower die shoe cutting surfaces 182, for example, during storage and transportation of the manufacturing die 150. Further, the die spacing device 110 may be coupled to guide pins 160 of the upper die shoe 170 when the manufacturing die 150 is placed into engagement with a press ram. During this process, the die spacing devices 110 are first coupled to the guide pins 160. Next, the press ram is placed in contact with the upper die shoe 170, lowering the upper die shoe 170 such that the die spacing devices 110 are in contact with the upper die shoe 170 and the lower die shoe 180. Next, the press ram applies pressure to the upper die shoe 170, compressing the die spacing devices 110 about 5-10 mm. The upper die shoe 170 is then coupled to the press ram using bolt fasteners, or the like. Once the upper die shoe 170 is coupled to the press ram, the upper die shoe 170 may be moved away from the lower die shoe 180 and the die spacing devices 110 may be removed. It should be understood that the die spacing devices 110 may be positioned on the guide pins 160 of the manufacturing die 150 for any exemplary process and purpose in which a temporary positive stop is desired.

Figure 7:
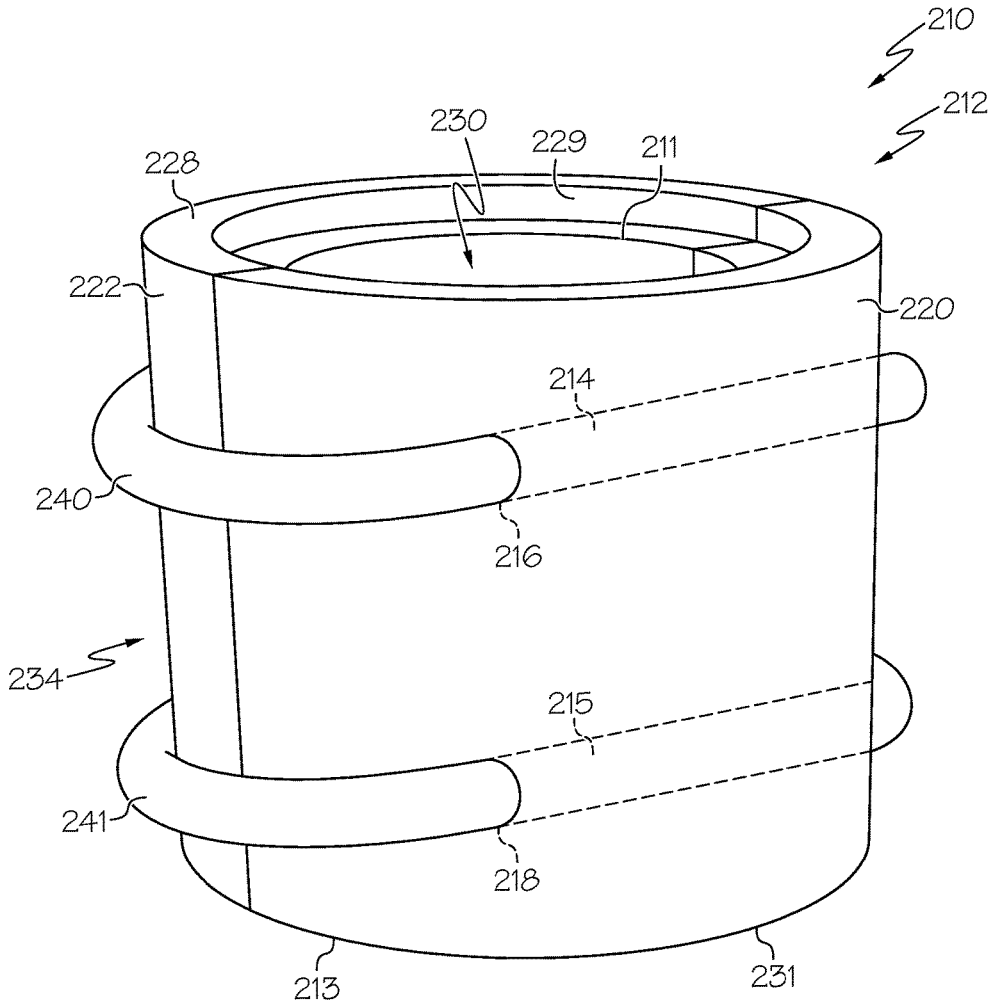
FIG. 7 depicts an isometric view of another example die spacing device in a closed configuration according to one or more embodiments shown or described herein.

Referring now to FIG. 7, an alternative embodiment of a die spacing device 210 is depicted. In this embodiment, the die spacing device 210 comprises a die spacing device body 212 and includes first and second arcuate pieces 220, 222, each having flexible resilient member channels 214 and 215. The die spacing device body 212 includes a top 211, a bottom 213 and a circular opening 230 extending from the top 211 to the bottom 213. Further, the die spacing device body includes end surfaces 228 and 231 which may include shoulder portions 229. In the embodiment of FIG. 7, the flexible resilient member channel 214 includes a bore portion 216 extending through the first arcuate piece 220 and an additional bore portion extending through the second arcuate piece 222. The flexible resilient member channel 215 includes a bore portion 218 extending through the first arcuate piece 220 and an additional bore portion extending through the second arcuate piece 222. Flexible resilient members 240 and 241 may fit within the bore portions of the flexible resilient member channels 214 and 215 (e.g., within bore portions 216 and 218 and within any additional bore portions).

Further, the flexible resilient member channels 214 and 215 may comprise a combination of groove portions (e.g., groove portions 116, 117, 117, and 119 of FIGS. 2 and 3) and bore portions (e.g., bore portions 216 and 218 of FIG. 7) positioned in alignment such that the groove portions and the bore portions form a continuous pathway around and through the first arcuate piece 220 and the second arcuate piece 222. While the die spacing device 210 is depicted in a contracted configuration 234, it should be understood that the die spacing device 210 may be selectively positioned in the contracted configuration 234 and in an extended configuration.

It should now be understood that manufacturing die assemblies include manufacturing dies having guide pins and die spacing devices configured to be removably engaged to the guide pins. The die spacing devices include a plurality of arcuate pieces and one or more flexible resilient members extendable around and/or through the arcuate pieces to provide an inward radial force to the plurality of arcuate pieces. In particular, the die spacing devices may be removably positioned in a frictional engagement with each guide pin of the manufacturing die to provide a temporary positive stop between an upper guide shoe and a lower guide shoe. The die spacing devices may coupled to the guide pins anytime a positive stop between upper die shoe and the lower die shoe is desired, for example, before the manufacturing die undergoes a spotting process and when the manufacturing die is being coupled to a press ram.

It is noted that the term "substantially" may be utilized herein to represent the inherent degree of uncertainty that may be attributed to any quantitative comparison, value, measurement, or other representation. This term is also utilized herein to represent the degree by which a quantitative representation may vary from a stated reference without resulting in a change in the basic function of the subject matter at issue.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

What is claimed is:

1. A die spacing device comprising:

a die spacing device body comprising:

a first arcuate piece comprising a side face and a compressible material sized and configured to extend about a portion of a guide pin of a manufacturing die;

a second arcuate piece comprising a side face and a compressible material sized and configured to extend about another portion of the guide pin of the manufacturing die;

a first flexible resilient member channel disposed in the first arcuate piece;

a second flexible resilient member channel disposed in the second arcuate piece; and a flexible resilient member configured to fit within the first flexible resilient member channel of the first arcuate piece and the second flexible resilient member channel of the second arcuate piece and configured to apply an inward radial force to the first arcuate piece and the second arcuate piece in contracted and extended configurations, wherein:

the die spacing device body is movable between the contracted and expanded configurations;

the side face of the first arcuate piece and the side face of the second arcuate piece are in continuous contact in the contracted configuration, thereby forming a seam extending from an inner surface of the first arcuate piece and the second arcuate piece to an outer surface of the first arcuate piece and the second arcuate piece; and the side face of the first arcuate piece and the side face of the second arcuate piece are spaced apart in the expanded configuration.

2. The die spacing device of claim 1, wherein the first arcuate piece and the second arcuate piece each comprise a compressible polymer.

3. The die spacing device of claim 1, wherein:

the first flexible resilient member channel of the first arcuate piece and the second flexible resilient member channel of the second arcuate piece each comprise a groove portion disposed in the outer surface of the first arcuate piece and the outer surface of the second arcuate piece, respectively; and the flexible resilient member is positioned within the groove portions of the first flexible resilient member channel and the second flexible resilient member channel such that the flexible resilient member extends circumferentially about the die spacing device body.

4. The die spacing device of claim 1, wherein:

the first flexible resilient member channel of the first arcuate piece comprises a bore portion extending through the first arcuate piece; and the second flexible resilient member channel of the second arcuate piece comprises a bore portion extending through the second arcuate piece.

5. The die spacing device of claim 1, wherein when the die spacing device body is in the contracted configuration, the die spacing device body comprises a contracted inner diameter, wherein the contracted inner diameter is sized and configured to be smaller than a diameter of a guide pin of a manufacturing die.

6. The die spacing device of claim 1, wherein when the die spacing device body is in the expanded configuration, the die spacing device body comprises an expanded inner diameter, wherein the expanded inner diameter is sized and configured to be larger than a diameter of a guide pin of a manufacturing die.

7. The die spacing device of claim 1, wherein the die spacing device further comprises an end surface sized and configured to contact an upper die shoe of a manufacturing die or a lower die shoe of a manufacturing die.

8. The die spacing device of claim 7, wherein the end surface further comprises a shoulder portion comprising a counterbore sized and configured to fit around a protruding portion of a guide pin of a manufacturing die.

9. The die spacing device of claim 8, wherein the end surface is a planar surface.

10. The die spacing device of claim 1, wherein the flexible resilient member comprises an elastic cord extendable about the die spacing device body, wherein the elastic cord comprises a first cord end and a second cord end.

11. The die spacing device of claim 10, further comprising one or more flexible resilient member attachment mechanisms configured to couple the first cord end of the flexible resilient member with the second cord end of the flexible resilient member when the flexible resilient member is extended about the die spacing device body.

12. The die spacing device of claim 1, wherein the flexible resilient member comprises an o-ring.

13. The die spacing device of claim 1, wherein the die spacing device body has a height of from 50 mm to 500 mm.

* * * * *